US005660569A

United States Patent [19]

Yamada et al.

[11] Patent Number: 5,660,569

[45] Date of Patent: Aug. 26, 1997

[54] CONTACT TERMINAL FOR A CIRCUIT BOARD

[75] Inventors: Satoshi Yamada; Shigemitsu Inaba, both of Shizuoka, Japan

[73] Assignee: Yazaki Corporation, Tokyo, Japan

[21] Appl. No.: 569,981

[22] Filed: Dec. 8, 1995

[30] Foreign Application Priority Data

Dec. 9, 1994 [JP] Japan ..... 6-306081

[51] Int. Cl.[6] ..... H01R 4/48

[52] U.S. Cl. ..... 439/862; 439/851

[58] Field of Search ..... 439/851, 856, 439/857, 861, 862, 839, 842

[56] References Cited

U.S. PATENT DOCUMENTS 3,487,356 12/1969 Buck et al. ..... 439/861

4,734,064 3/1988 Knapp et al. ..... 439/856

FOREIGN PATENT DOCUMENTS 5-62972 8/1993 Japan .

*Primary Examiner*—David L. Pirlot
*Assistant Examiner*—Brian J. Biggi
*Attorney, Agent, or Firm*—Morgan, Lewis and Bockius, LLP

[57] ABSTRACT

In a terminal in which a contact plate portion of a contact spring piece is projected through an opening of a bottom plate portion and a stop plate at the tip end of a rear plate portion bent from the contact plate portion is to butt against the opening edge of the bottom plate portion, curved parts are formed in a range extending from the contact plate portion to the rear plate portion. The curved parts have an arcuate section taken along a width direction of the spring piece.

5 Claims, 4 Drawing Sheets

CONTACT TERMINAL FOR A CIRCUIT BOARD

BACKGROUND OF THE INVENTION

1. Field of the Invention

The invention relates to a contact terminal for a circuit board in which a contact spring piece is projected to the outside of the terminal so as to make contact with a circuit board.

2. Related Art

FIGS. 7 and 8 depict a contact terminal for a circuit board which is disclosed in Unexamined Japanese utility model publication No. HEI 5-62972.

In the contact terminal 25, an opening 3 is formed in a bottom plate portion 2 so that a contact plate portion 27 of a spring piers 26, which is continuously raised from the bottom plate portion 2, is projected through the opening 3. The spring piece 26 comprises a sloped portion 10 which is raised from the bottom plate portion 2, a flat plate-shaped contact plate portion 27, which is downwardly bent from the sloped portion 10 and is positioned in a substantially horizontal manner in a free standing state, and a rear plate portion 28 which is upwardly bent from the contact plate portion 27 and has, at the tip end, a perpendicularly elongated stop plate 12.

A contact projection (indent) 29 having a substantially hemispherical shape is sweat welded onto the contact plate portion 27. As depicted in FIGS. 9 and 10, the contact projection 29 makes contact with a counter circuit board 18. Specifically, when the contact terminal 25 is inserted into a connector housing 17, as shown in FIG. 9, the sloped portion 10 of the spring piece 26 simultaneously butts against butting wall 20 inside the housing, so as to be directed downwardly, resulting in the contact plate portion 27 being projected through the opening 3. The stop plate 12 butts against the bottom plate portion 2, thereby restricting the amount of the contact plate portion 27 that is projected through the opening.

Subsequently, as shown in FIG. 10, the circuit board 18 is inserted into the connector housing 17 along the contact plate portion 27, and then slidably contacts with the contact projection 29. The contact plate portion 27 is marginally disposed upwardly by the circuit board 18 So that the stop plate 12 is disposed upwardly and loses contact with the bottom plate portion 2.

However, the above-described structure of the prior art has the following drawback. In FIG. 10, the tip end 18*a* of the circuit board 18 butts against the contact projection 29, thereby producing concerns that the spring piece 26 is deformed, that circuit elements on the counter circuit board 18 are shaven off, and that the contact of the insertion of the counter circuit board 18 is impaired. In the case where, as shown in FIGS. 11 and 12, the spring piece 26 is pushed in the projection direction by an operation such as the insertion of the contact terminal 25 into the connector housing 17, if the stop plate 12 is too short, there arises a concern that the spring piece 26 is deflected and deformed and the stop plate 12 easily slips off the opening edge 2*a* of the bottom plate portion 2.

SUMMARY OF THE INVENTION

The invention was made to solve the problems discussed above. It is an object of the invention to provide a contact terminal for a circuit board in which interference between a circuit board and a spring piece does not cause the deformation of the spring piece, the shaving of circuit elements impairment of the mating of the circuit board upon its insertion, and the stop plate is prevented from slipping off of the opening edge of the bottom plate portion.

In order to attain the objectives of the invention, the invention provides a contact terminal for a circuit board in which a contact plate portion of a contact spring piece is projected through an opening of a bottom plate portion. A stop plate, at the tip end of a rear plate portion, which is bent away from the contact plate portion is butted against an edge of the opening of the bottom plate portion. A curved part is formed in a range extending from the contact plate portion to the rear plate portion. The curved part has an arcuate section taken along the width direction of the spring piece.

The contact plate and the rear plate portions rigidity is improved by the curved part. When the curved part of the contact plate portion comes into contact with the circuit board, the high rigidity of the curved part prevents the contact plate portion from being deflected and deformed, and the curved part is securely contacted with the circuit board due to the high contact pressure. The central portion, in the width direction, of the curved part is point-contacted or line-contacted with the circuit board smoothly without causing any obstruction. In the rear plate portion, the curved part rigidity is improved such that deflection deformation is suppressed. This causes the stop plate to securely butt against the opening edge of the bottom plate portion, thereby preventing the stop plate from slipping off.

DETAILED DESCRIPTION OF THE PREFERRED EMBODIMENTS

Figure 1:
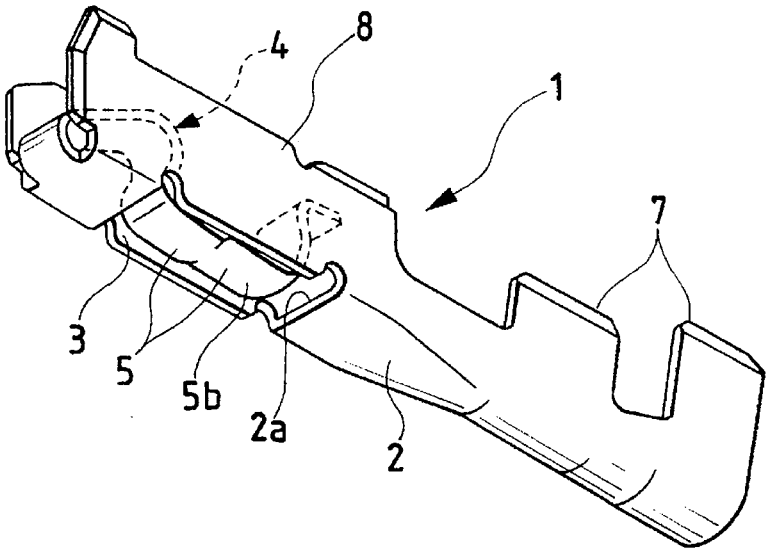
FIG. 1 is a perspective view showing an embodiment of the contact terminal for a circuit board according to the invention.
Figure 2:
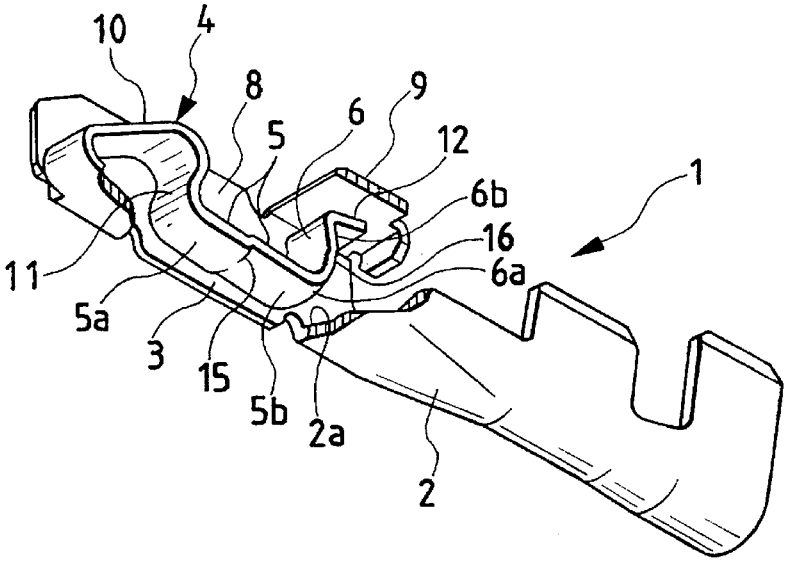
FIG. 2 is a partially cutaway perspective view depicting the main portion of the contact terminal.
Figure 3:
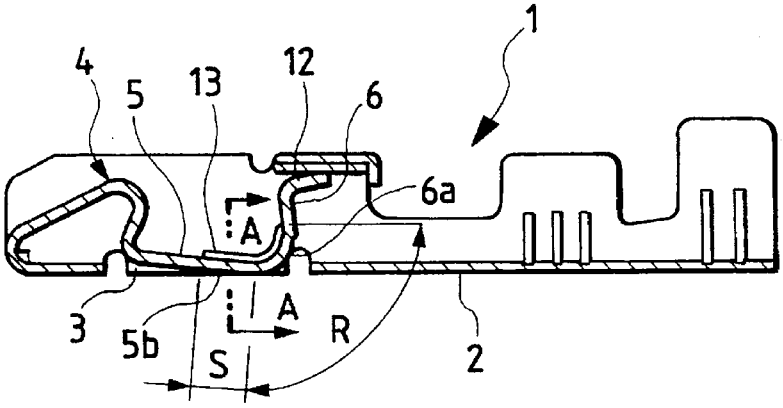
FIG. 3 is a longitudinal section view of the contact terminal.

FIGS. 1 to 3 show an embodiment of the contact terminal for a circuit board according to the invention.

Figure 4:
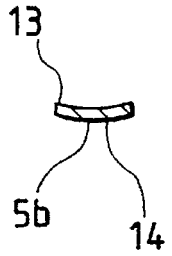
FIG. 4 is a section view taken along line A—A in FIG. 3.

In the same manner as the conventional terminal, the contact terminal 1 comprises an opening 3 which is formed in a bottom plate portion 2, and a spring piece 4 which is continuously raised from the bottom plate portion 2. The contact terminal 1 is comprised of, as shown in FIG. 4, a contact plate portion 5 and a rear plate portion 6 of the spring piece 4 which is projected outside through the opening 3 is formed into a shape of an arcuate section.

The bottom plate portion 2 extends to a wire crimp piece 7 in the reward direction and also to side plate portions 8 in the forward direction. The side plate portions 8 are fixed to a connecting plate 9. The spring piece 4 is located between the side plate portions 8, and comprises: a sloped portion 10 which is raised from the tip end of the bottom plate portion 2; a front plate portion 11 which is downwardly bent from the sloped portion 10; a contact plate portion 5 elongated from the front plate portion 11 and along the opening 3 so as to be positioned in a substantially horizontal or reward-leaning manner in a free standing state; a rear plate portion 6 which is upwardly bent from the contact plate portion 5; and a stop plate 12 which rearwardly extends from the tip end of the rear plate portion 6 so as to be perpendicularly elongated.

The contact plate portion 5 consists of a flat area 5*a* in the front half, and a curved part (round-shaped part) 5*b* in the rear half (FIG. 2). The curved part 5*b* is formed so that the S region, depicted by S in FIG. 3, elongates horizontally in the longitudinal direction, and the part (6*a*) extending over the lower half of the rear plate portion 6 is curved continuously throughout the R range in the figure in the longitudinal direction of the spring piece. As shown in FIG. 4, the curved parts 5*b* and 6*a* are arcuately curved along the width direction of the spring piece. The side edges 13 of the spring piece 4 are positioned so as to be higher than the center of the spring piece, and the spring piece has at the center a contact vertex 14 which is downwardly directed.

The curved part 5*b* is substantially continuous in a center area in the longitudinal direction of the contact plate portion 5, extending to the flat area 5*a* through step areas 15 (FIG. 2) on the both sides. In the rear plate portion 6, the curved part 6*a* is substantially continuous in a center area in the height direction, extending to a flat portion 6*b* through step portion 16. The flat portion 6*b* is continuous to the stop plate 12 which elongates perpendicularly. Unlike the contact plate portion in the prior art, the contact plate portion 5 is not provided with a contact projection, and has a smooth curved face (5*b*). The contact plate portion 5 and the rear plate portion 6 are rigidly improved by the curved parts 5*b* and 6*a*, and exhibit higher deflection rigidity than that of a conventional spring piece having a flat plate-shaped section.

Figure 5:
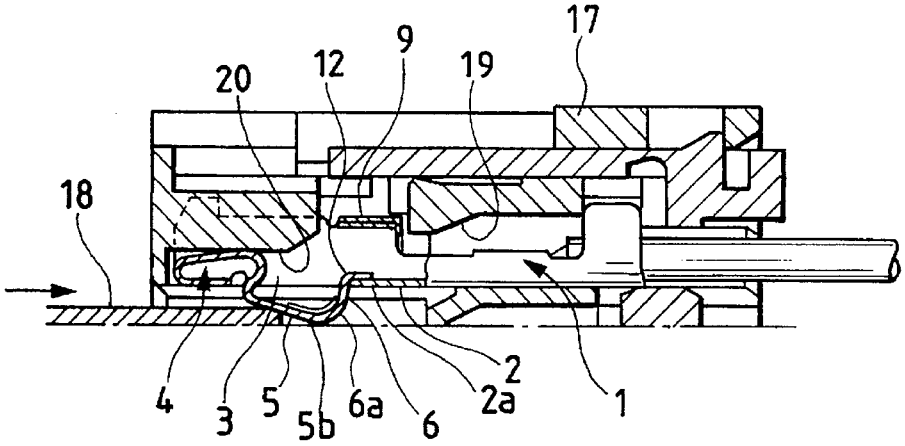
FIG. 5 is a longitudinal section view depicting the contact terminal disposed in a connector housing.
Figure 6:
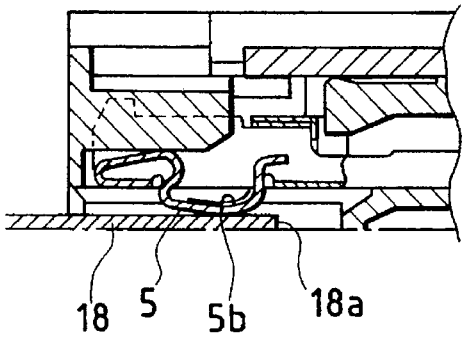
FIG. 6 is a longitudinal section view depicting the contact terminal in contact with a circuit board.
Figure 7:
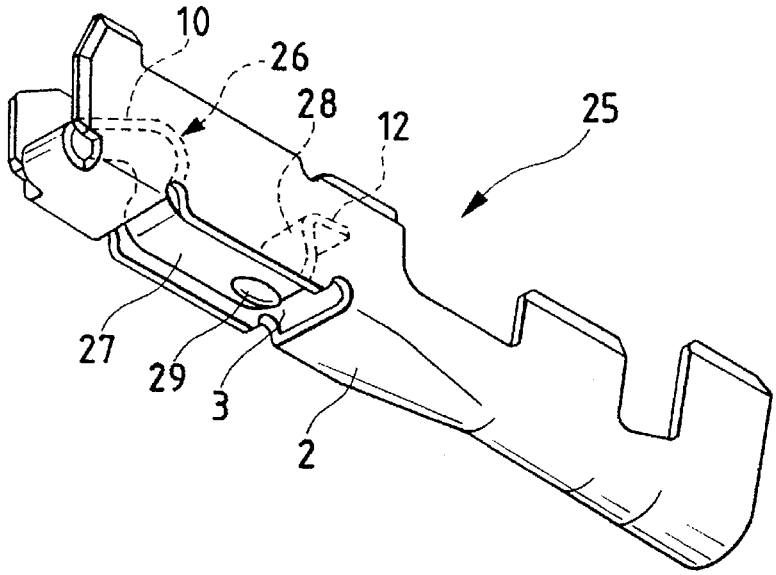
FIG. 7 is a perspective view showing a conventional contact terminal.
Figure 8:
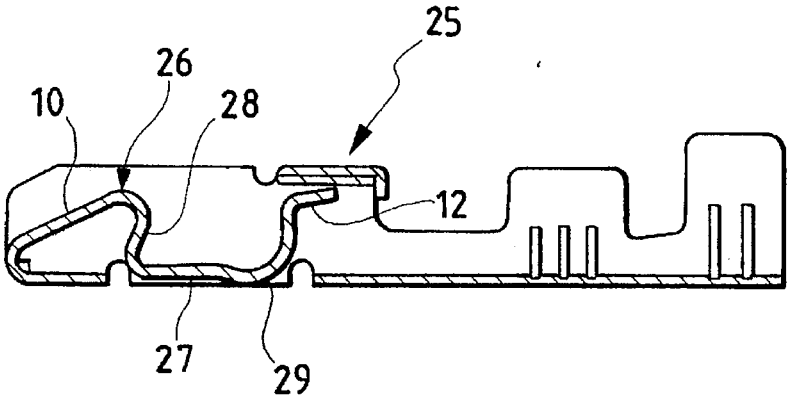
FIG. 8 is a longitudinal section view of the conventional contact terminal.
Figure 9:
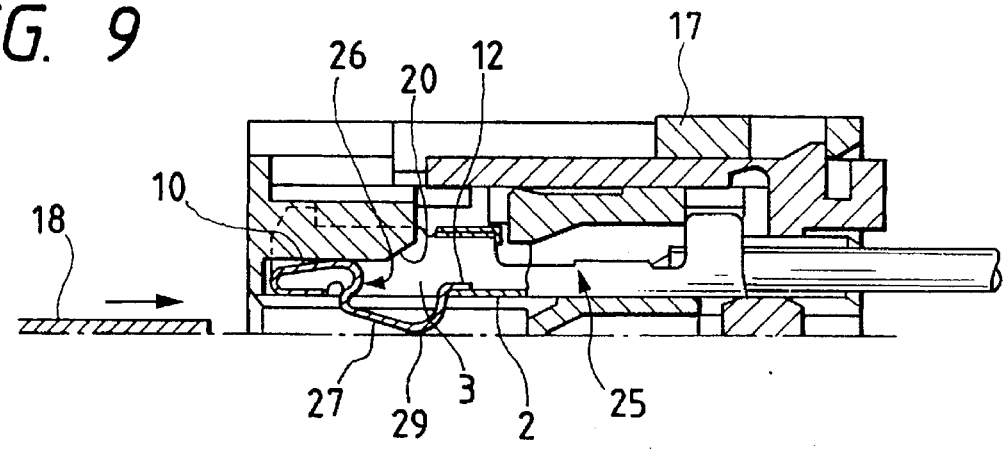
FIG. 9 is a longitudinal section view depicting a conventional contact terminal disposed within a connector housing.
Figure 10:
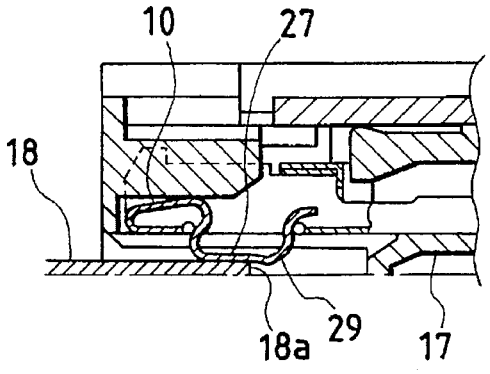
FIG. 10 is a longitudinal section view depicting a conventional contact terminal in contact with a circuit board.
Figure 11:
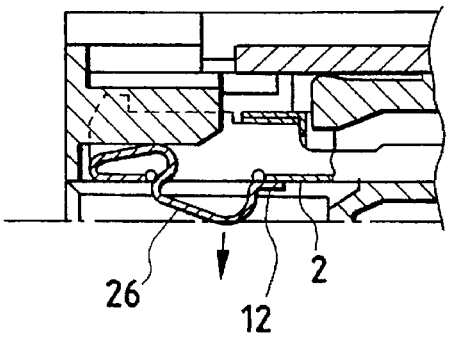
FIG. 11 is a longitudinal section view depicting a stop plate that has slipped off an opening edge.
Figure 12:
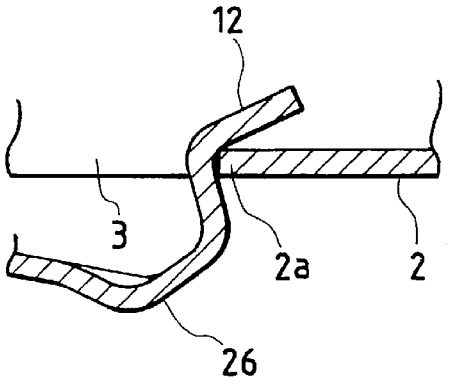
FIG. 12 is a section view depicting a rear plate portion being deflected and deformed.

FIGS. 5 and 6 depict the contact terminal 1 accommodated in a connector housing 17 and a counter circuit board 18 inserted toward the contact plate portion 5.

As shown in FIG. 5, the upper connecting plate 9 of the contact terminal 1 is engaged with an engagement lance 19 in the rear portion, and the spring piece 4 is disposed downwardly by the butting wall 20 in the front portion. The contact plate portion 5 of the spring piece 4 is projected through the opening 3 so as to be inclined in a rearwardly-leaning manner. The stop plate 12 is supported by the rear plate portion 6 to which the curved part 6*a* provides the rigidity, so as to securely butt against an opening edge 2*a* of the bottom plate portion 2. Therefore, unlike a rear plate portion in the prior art even when a downwardly directed force acts on the spring piece 4, the rear plate portion 6 is not deflected and deformed, and the stop plate 12 does not slip off from the opening edge 2*a*.

As shown in FIG. 6, the circuit board 18 is smoothly slid into contact with the contact plate portion 5. Specifically, the vertex 14 (FIG. 4), at the center in the width direction of the curved part 5*b*, is point-contacted with the circuit board 18 or line-contacted therewith in the longitudinal direction of the contact plate portion. Unlike a contact plate portion in the prior art, the contact plate portion 5 is not provided with a contact projection. Therefore, the tip end 18*a* of the circuit board 18 is prevented from pushing the spring piece 4 to deform it, and circuit elements on the circuit board 18 are not shaven off. Since the presence of the curved part 5*b* increases the rigidity of the contact plate portion 5 in the thickness direction, the contact plate portion 5 is prevented from deflection and deformation with respect to the circuit board 18, and therefore contacts the circuit board 18 with a high contact pressure.

As described above, according to the invention, the contact plate portion is rigidly improved by the curved part. When the contact plate portion is contacted with a counter circuit board the contact plate portion is prevented from deflection and deformation, so that the contact plate portion (curved part) contacts the circuit board with a high contact pressure, thereby enhancing the reliability of the electrical connection. Unlike a conventional terminal, the present terminal has no contact projection, and slides smoothly into contact with a circuit board at the vertex in the width direction of the curved part. Consequently, any obstruction which is formed in the prior art is not formed between the terminal and the circuit board. Therefore, the spring piece is prevented from being deformed and circuit elements are prevented from being shaven off. Furthermore, since the presence of the curved part increases the rigidity of the rear plate portion, the deflection deformation of the contact plate portion is suppressed, and the stop plate is prevented from slipping off of the opening edge.

What is claimed is:

1. A contact terminal for a circuit board comprising:

a contact spring piece having a contact plate portion projected through an opening of a bottom plate portion;

a rear plate portion having an end;

a stop plate at the end of the rear plate portion, which is bent from said contact plate portion, butting against an edge of said opening of said bottom plate portion; and a curved part formed in a range extending from said contact plate portion to said rear plate portion, said curved part having an arcuate section taken along a width direction of said spring piece.

2. A contact terminal for a circuit board comprising:

a bottom plate portion a contact spring piece having a contact plate portion projected through an opening of the bottom plate portion;

a rear plate portion having an end;

a stop plate at the end of the rear plate portion;

a curved part formed in a range extending from the contact plate portion to the rear plate portion, the curved part having an arcuate section taken along a width direction of the spring piece.

3. A contact terminal for a circuit board comprising:

a bottom plate portion;

a contact spring piece having a contact plate portion projected through an opening of the bottom plate portion;

a rear plate portion having an end;

a stop plate at the end of the rear plate portion; and a curved part formed in a range extending from the contact plate portion to the rear plate portion, the curved part having an arcuate section taken along a width direction of the spring piece;

wherein the curved part is formed so that a first section of the curved part elongates straightly in the longitudinal direction and a second section of the curved part curves in the longitudinal direction.

4. The contact terminal for a circuit board as claimed in claim 3, wherein the spring piece further comprises:

a slope portion which is raised from the tip end of the bottom plate portion; and a front plate portion which is downward bent from the slope portion.

5. The contact terminal for a circuit board as claimed in claim 4, wherein the rear plate portion is bent upward from the contact plate portion.

* * * * *